United States Patent [19]

Adam

[11] Patent Number: 4,537,399

[45] Date of Patent: Aug. 27, 1985

[54] GRIP FOR A RACKET, ESPECIALLY A TENNIS RACKET

[75] Inventor: Günter Adam, Straubing, Fed. Rep. of Germany

[73] Assignee: Puma-Sportschuhfabriken Rudolf Dassler KG, Fed. Rep. of Germany

[21] Appl. No.: 627,512

[22] Filed: Jul. 3, 1984

[30] Foreign Application Priority Data

Jul. 5, 1983 [DE] Fed. Rep. of Germany ..... 3324145

[51] Int. Cl.[3] ..... A63B 49/08

[52] U.S. Cl. ..... 273/75; 273/73 J

[58] Field of Search ..... 273/75, 73 J, 81.2, 273/67 R, 67 A, 67 DA, 67 DB

[56] References Cited

U.S. PATENT DOCUMENTS

| | | | |
|---|---|---|---|
| 3,501,148 | 3/1970 | Cheris et al. | 273/73 J X |
| 3,582,072 | 6/1971 | Stueck | 273/73 J |
| 3,674,267 | 7/1972 | Hollis | 273/75 |
| 3,833,219 | 9/1974 | Dean | 273/73 J X |
| 3,931,968 | 1/1976 | Hedberg | 273/75 |
| 4,033,583 | 7/1977 | Ehrhart | 273/73 J X |
| 4,438,925 | 3/1984 | Lindstrom | 273/73 J X |

FOREIGN PATENT DOCUMENTS

| | | | |
|---|---|---|---|
| 1112435 | 8/1961 | Fed. Rep. of Germany | 273/73 J |
| 1959368 | 11/1970 | Fed. Rep. of Germany | 273/73 J |
| 2106800 | 9/1971 | Fed. Rep. of Germany | . |
| 2458572 | 6/1976 | Fed. Rep. of Germany | 273/75 |
| 2458581 | 6/1976 | Fed. Rep. of Germany | 273/75 |
| 2632705 | 1/1978 | Fed. Rep. of Germany | 273/73 J |

*Primary Examiner*—Paul E. Shapiro

*Attorney, Agent, or Firm*—Sixbey, Friedman & Leedom

[57] ABSTRACT

A hand-grip for a racket, especially a tennis racket of the type having a hand-grip sleeve formed of longitudinally extending components mountable on a shaft of a racket frame connected to a hitting surface, according to the invention, utilizes at least two similar shell parts, made of a hard, elastic material, that have longitudinally extending edge portions which are arranged in such a way that, when the hand-grip sleeve rests firmly against the shaft, adjacent edge portions laterally overlap without end faces thereof abutting against one another. The hand-grip sleeve is provided with an elastic covering which presses the sleeve against the shaft on all sides.

22 Claims, 9 Drawing Figures

GRIP FOR A RACKET, ESPECIALLY A TENNIS RACKET

BACKGROUND AND SUMMARY OF THE INVENTION

This invention relates to a grip for a racket, especially a tennis racket, having longitudinally extending components joined together about a shaft of the racket frame to form a hand-grip.

A racket, especially a tennis racket, of this type is known from DE-OS No. 21 06 800. The grip of this known tennis racket consists of a hand-grip preferably formed of two grip halves, that are firmly arranged on the shaft with an insert of a shock- or vibration-damping material placed therebetween. The two grip-halves are screwed together. In this case, the screws penetrate the shaft through boreholes which are larger than the diameter of the screws. So that the screws do not touch the walls of the boreholes, the grip must not slip on the shaft. For this reason, the screws must press the insert tightly against the shaft, the damping material insert has the purpose of avoiding the effect that hard impacts transferred to the arm of the player in an undampened way may have especially to the arm of a tennis player.

The present invention, among other things, has a primary objective of being able to fasten, a grip which has good damping characteristics in a simple manner, firmly on a shaft or so that it can be moved. As a secondary object, it is desired to achieve such in way that may be manufactured in a relatively inexpensive manner and, if possible, no additional fastening means should be required to hold the grip on the shaft either firmly or so that it can be moved.

These objectives are achieved, in accordance with preferred embodiments of the invention, through the use of at least two identical or at least similar shell parts which are formed of a hard, elastic material and which are arranged so as to firmly engage against the hand-grip shaft with their mutually facing longitudinal edge portions in a laterally overlapping relationship creating a gap between their end faces, i.e., there is no end-on abutting, relationship. The hand-grip sleeve so formed is provided with an elastic covering for pressing the grip sleeve onto the shaft of the frame.

By the use of a hard elastic material for the hand-grip shell parts, a fastening of the shell parts may, for example, take place by means of an elastic covering in the form of an elastic tube or an elastic strip that preferably, at the same time, may be a grip strip. Special fastening means, such as screws, are therefore not required. Nevertheless, the grip holds firmly onto the shaft so that it cannot be moved when the elastic covering surrounds the hand-grip sleeve in a correspondingly firm manner, or the grip is attached just so firmly that it can still be adjusted on the shaft. The latter has the advantage that the racket itself may be adjusted according to the strength and/or the skill of the player, because in this manner the "weight", i.e., the location of the center of gravity of the racket can be changed. This invention can, therefore, especially advantageously be used in the case of a racket having an adjusting mechanism for the grip as it is, for example, shown and described in my copending patent application filed on even date herewith and claiming priority based upon German Application No. P 33 24 140.6 of July 5, 1983.

Rackets, particularly tennis rackets, having a hand-grip sleeve which is telescopingly adjustable over the shaft of the racket frame for changing the rocket handle length are known. However, because of the manner of construction of the hand-grip sleeves of such rackets, the sleeve itself cannot achieve both a slidable engagement with the racket shaft and a firm enough contact to prevent inadvertent slippage during use, without the provision of some auxillary fastening means, such as a screw.

For example, in U.S. Pat. No. 3,674,267, a tennis racket with an adjustable grip is disclosed wherein a hand-grip sleeve, comprised of a seamless aluminum or plastic tube, is frictionally fit over the shaft of the racket frame, but to secure the hand-grip at a desired longitudinal position, a fastening screw is attached through holes provided in the hand-grip and the shaft of the frame. A similar situation exists for the tennis racket with an adjustable handle that is disclosed in U.S. Pat. No. 3,931,968, which has a hand-grip sleeve formed of two half-shells. Since the two half-shells abut, end-on, along their longitudinal edge-walls, a firm clamping of the shaft, by the half-shells, cannot be assured, particularly in view of an internal chamber that is provided within the hand-grip formed by the half-shells. Thus, positional locking of the hand-grip relative to the racket frame shaft is achieved by a spring detent arrangement, and a wing screw may, additionally, be provided to further insure that a secure clamping is achieved.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

A hand-grip 1 of a racket is arranged on a shaft 2 that is part of a frame forming a ball-hitting surface, which in the case of a tennis racket is strung.

Figure 1:
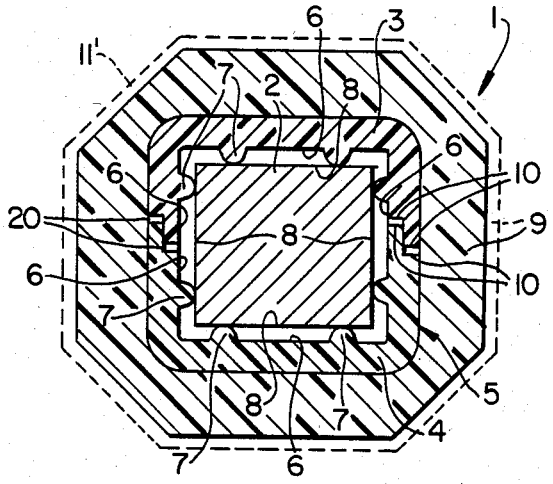
FIGS. 1 to 5 show different embodiments of a hand-grip of a racket in accordance with the invention in sectional view.

According to FIG. 1, the hand-grip 1 is comprised of a hand-grip sleeve 5 that is formed of two identical shell parts 3 and 4. The shell parts 3, 4, have inside walls 6 which may rest directly on the hand-grip shaft 2 of the racket frame or may engage thereagainst by way of knub-shaped or acutely conical elevations or ribs 7, especially longitudinal ribs, formed unitarily thereon. When individual, especially acutely conical elevations are used, a firm fit is obtained on the shaft 2 because they are pressed against the shaft 2 with high surface pressure. When round elevations or, especially longitudinal ribs 7 are used, the grip shell 5 may be constructed so that it can be moved longitudinally on the frame shaft 2.

In order to produce the necessary contact pressure between the hand-grip sleeve and the shaft 2, an elastic covering 9 is used that surrounds the hand-grip sleeve 5. The covering 9 in FIG. 1, is formed of a soft plastic material, such as soft polyurethane foam, that is sprayed around the hand-grip sleeve 5. As can be seen, in this arrangement according to the invention, the longitudinally extending edge portions of the shell parts particularly laterally overlap, but their end faces 10 do not abut against one another. A small gap 20, therefore, always remains between these end faces which, in connection with the pressure caused by the elastic covering 9, ensures a secure holding of a hand-grip sleeve 5, and thus, also of the grip 1, on the shaft 2. In this case, the shaft thickness may vary within certain limits without adverse effect so that manufacturing tolerances of the shaft 2 can easily be compensated for. The soft-plastic covering 9 may, in addition, be provided with a grip strip 11' (shown by broken line) of leather or the like wrapped therearound.

Figure 2:
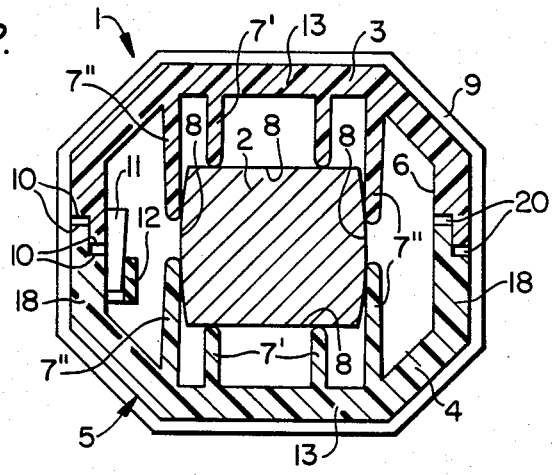
Figure 6:
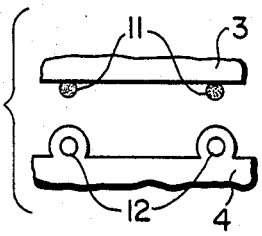
FIGS. 6 and 7 shown embodiments for catch profile arrangements in the area of the parting planes of half-shells forming the hand-grips of the racket.
Figure 7:
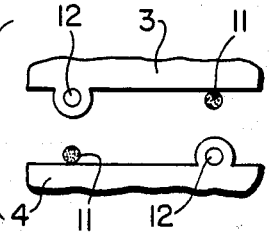

The overlap of longitudinally extending edge portions may in particular be achieved by the stepped seam shown or a grooved-seam-type, or other catch, wedging or snapping profiles may be provided in the area or areas of the end faces 10. Especially, wedge-shaped pins 11 and bushings 12 may be formed on the inside walls of the edge portions in the area of the end faces 10, as shown in FIG. 2 and FIGS. 6 and 7, so that the pins and/or bushings on one shell part will inter-engage with the other of bushing or pins of a second shell part. That is, only pins 11 may be placed adjacent the end wall of one shell part with the other having only bushings 12 (FIG. 6), or bushings and pins may be provided on both in oppositely staggered fashion (FIG. 7).

In accordance with the embodiment of FIG. 2, shorter center ribs 7' and longer outside ribs 7'' are provided extending at least approximately normal to the bottom wall 13 of the generally U- or trough-shaped shell parts 3, 4. In this case, the center ribs 7' are aimed directly against front and back side walls 8 of the shaft 2. On the other hand, the outside ribs 7'' are arranged in such a way that, when the shell parts 3, 4 are placed on the shaft 2, they elastically press against the lateral side walls 8 of the shaft 2 or are elastically deflected by these side walls toward the exterior. This or a similar arrangement is particularly well suited for a good slidability of the grip 1 on the shaft 2. By means of the perpendicular arrangement of the ribs 7, 7'' relative to the bottom wall 13, it is possible to easily manufacture the shell parts 3, 4 in a two-part injection mold. In FIG. 2, covering 9 is provided by a rubber tube or several rubber rings or by a grip strip that has to be wound, instead of a sprayed-on foam layer. Naturally, such a hand-grip sleeve 5 may also be provided with a soft-plastic covering (with or without a grip strip) as described relative to FIG. 1 embodiments.

Figure 3:
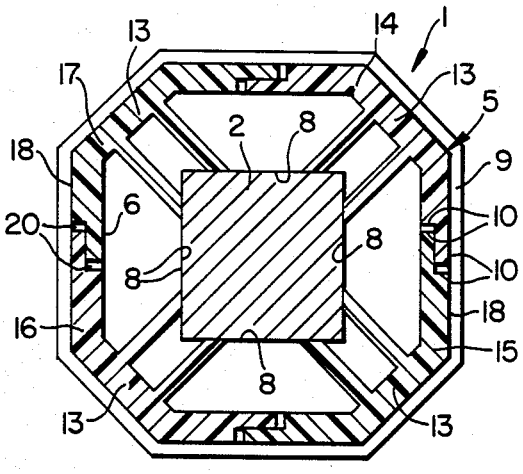

FIG. 3 shows an embodiment that is similar to that of FIG. 2 except that it has a hand-grip sleeve 5 consisting of four identical shell parts 14, 15, 16, 17. Here also, the elevations or ribs 7 are provided which project normal to the bottom 13 of the trough-shaped configuration of the shell parts 14 to 17. However, the ribs of this embodiment are not applied to the side walls 8 of the shaft 2 in the same manner as is the FIG. 2 embodiment. Instead of being parallel or perpendicular to the side-walls 8, the ribs are constructed and arranged to extend parallel to diagonals of the shaft, so that each corner edge of the shaft is held between a respective pair of ribs. Since this creates an arrangement where the ribs are elastically deformable, the result is an elastic holding of the hand-grip sleeve 5 on all sides and a good damping effect. The hand-grip sleeve 5 is again surrounded by the covering 9 which may be applied in the manner described relative to FIG. 1 or FIG. 2.

Figure 5:
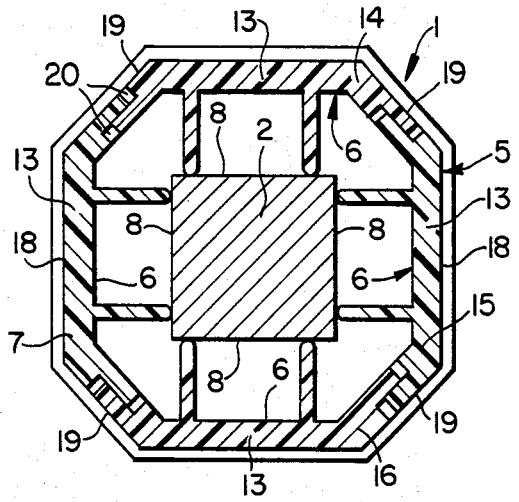

The end faces 10, in this case, are shown disposed in the longitudinal sides 18 of the grip-sleeve 5 formed by the grip parts 14 to 17. However, it may be expedient to arrange the end walls 10, not in the longitudinal sides 18, but in the corner sides 19, thus in the diagonal sides extending parallel with respect to the diagonals of the shaft 2, as shown in FIG. 5.

Figure 4:
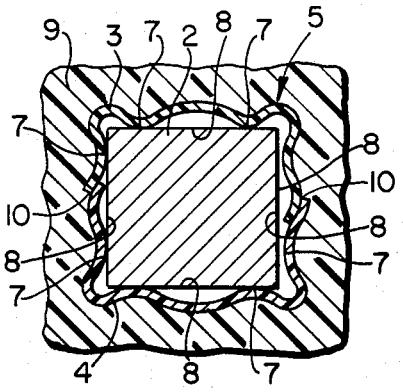

In another advantageous embodiment, the shell parts 3, 4, according to FIG. 4, may be configured to be elastic themselves. This is achieved by a suitable wavy shaping of the plastic shell parts 3, 4 so that they form some type of expansion joints. The longitudinal edge portion may laterally overlap in this case also.

It is advantageous to use, as the material for the shell parts, a suitable hard, springy-elastic plastic material. Especially, when the shell parts 3, 4 are to be slidable with respect to the shaft 2, the material should also have good sliding characteristics. Polyamides, such as "Hostaform", ABS, etc. have proven to be especially suitable plastics.

Even though the shell parts 3, 4 and 14 to 17 are preferably identical, since it minimizes the number of parts which must be manufactured, the identical development of the shell parts 3, 4 and 14 to 17 is not absolutely necessary. It is also within the realm of the invention to form the elevations and/or ribs 7, 7', 7'' differently, particularly where the shaft of the frame cross-sectional differs from that shown.

Figure 8:
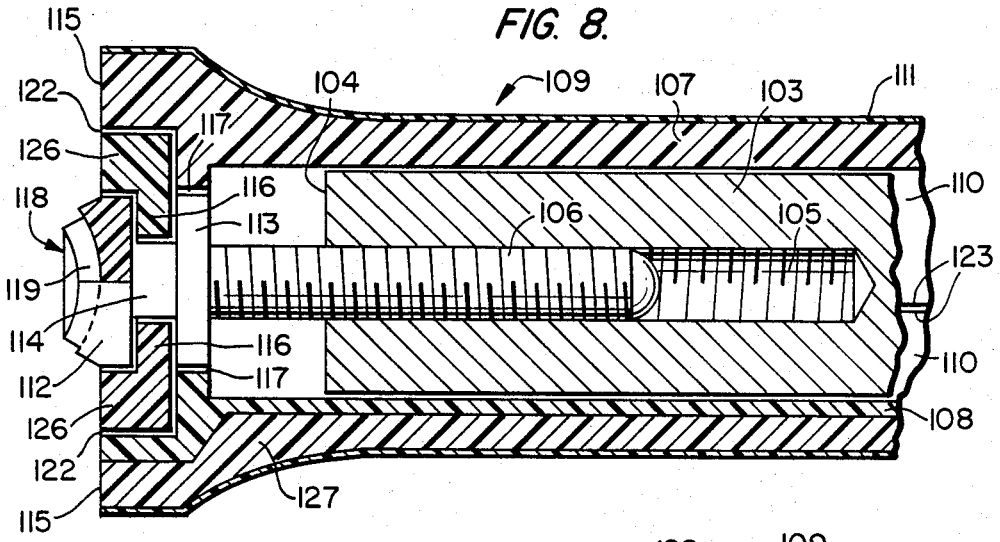
FIG. 8 shows a longitudinal cross-sectional view of a hand-grip according to the invention having an adjustment mechanism.

FIG. 8 shows a feature for a racket, especially a tennis racket, which in addition to any of the above characteristics is provided with an adjusting mechanism.

A grip 109 formed of two half-shells 107 and 108 is arranged on the shaft 103. The half-shells 107, 108 consist of a hard, practically non-compressible or inelastic material, such as rigid expanded plastic, especially on the basis of hard polyurethane or a thermoplast, like hard PVC, polyamide, polypropylene, polyethylene, etc. These materials have the characteristics they will slide well on a shaft 103 formed of wood, metal or plastic and they will not wear out very fast.

The two half-shells 107, 108 are placed on the shaft 103 and then are wound-over by an elastic strip 111, for example, a grip strip. By this measure, the half-shells 107, 108 are pulled against one another and rest flushly against the shaft 103. Nevertheless, the thus formed grip 109 can be slid relatively easily on the shaft 103.

In order to be able to adjust the hand-grip 109, at any time, so that it can be easily moved on the shaft 103, an adjusting screw 106 is provided which serves as the adjusting device and is connected between the hand-grip 109 and the shaft 103. The shaft is connected with the hand-grip 109 by means of a tongue-and-groove guide in that the adjusting screw 106, at the bottom end area, has a perimetic groove 114 formed between two guide disks 112, 113. Flange-like teeth or tongues 116 project inwardly from the bottom ends 115 of the half-shells 107, 108 into engagement within groove 114. The flange-like teeth or tongues 116, in the illustrated embodiment, are formed by inwardly projecting walls having semicircular recesses 117 for the adjusting screw 106.

Consequently, the adjusting screw 106 cannot be moved in axial or radial directions, but can be turned. By screwing said adjusting screw 106 into or out of the borehole 105, the grip 109 is slid in a longitudinal direction along the shaft 103 and its position, thus, adjusted so as to shorten or lengthen the racket. For the operation of the adjusting screw 106, its head 118 is provided with a slot 119, whereby it may be turned through use of an appropriate tool, coin or the like.

Instead of placing the half-shells 107, 108 together to form the hand-grip 109 by means of the elastic strip 111, they may also be fitted together by means of an elastic tube, made, for example, of rubber or by means of elastic tube sections. The hand-grip 109, the elastic strip 111, the tube or the tube sections will then be wound in the conventional way by a suitable grip strip that does not have to be elastic.

Advantageously, the tongues 116 are displaced slightly toward the inside in a manner which enables the head 118 of the adjusting screw 106 to be arranged within a recess 122.

The end faces 123 of the facing longitudinally extending edge portions of the half-shells 107, 108 are, expediently, inter-engaged with one another by means of a tongue-and-groove connection or by grooved seams. This arrangement is, advantageously, made in such a way that one of the end faces 123 has a groove and the other has a tongue or, as shown in FIGS. 1 to 3 and 5, one of the end faces 123 has a grooved inside seam and the other has a grooved outside seam. Thus, the half-shells 107, 108 are shaped identically so that only one mold is required for their manufacture.

Another advantageous characteristic is to form the flange-like teeth or tongue 116 as separate sliding members 26 consisting of a highly wear-resistant material having a low coefficient of friction. Such a material may be polyamide, polycarbonate, aluminum, brass, steel or a similar material. Preferably, two sliding members 126, that can be placed together to form a disk, are inserted in the recess 122 and can be fastened there. The fastening takes place preferably by screws and/or gluing-in.

The contour of the recess 122 is, preferably, not circular, and the sliding members 126 are adapted to this contour so as to be held in the recess 122 in a manner such that they cannot be turned and can be fastened easily by locking and/or gluing.

According to the invention, the half-shells 107, 108 may be provided with a soft-elastic layer 127, such as a foamed material, foam rubber or a similar material or are subsequently surrounded with such a material, for example, by spraying. This results in a good damping of hard blows and impacts so that these are not transferred directly to the player's hitting arm. This construction is shown by means of the lower half-shell 108 in FIG. 8. This layer 127 may still, even if it is a uniform covering, be provided with the expediently elastic grip strip 111 and/or with a tube or a tube section.

Figure 9:
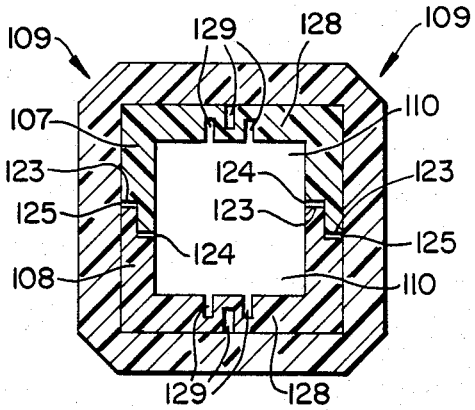
FIG. 9 shows a hand-grip formed of half-shells having expansion joints.

In order to especially balance tolerances or in order not to require the shell parts to be manufactured with great precision, at least one expansion joint 129 is provided in at least one wall of the half-shell 107, 108, preferably in the wall 128 between the end faces 123. Such an expansion joint 129 may, expediently, be formed by longitudinal grooves extending alternately from the inside toward the outside and from the outside toward the inside, as shown in FIG. 9 in a cross-sectional view.

The length of the adjusting screw 106 and the depth of the borehole 105 are dimensioned in such a way that the grip 109 can be moved on the shaft 103 by about 20 to 40 mm. However, as a rule an adjustment by ±10 mm from the normal position is sufficient, as shown in tests.

Still further aspects of the incorporation and use of the adjusting screw 106 within a racket handle formed of shell parts are noted in my above-mentioned patent application. Thus, to the extent necessary to complete an understanding of this invention, said application is hereby incorporated by reference.

While the main area of application of the invention concerns tennis rackets, it may, advantageously, also be used in other types of rackets, such as squash rackets, badminton rackets, racketball rackets, or other rackets.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

We claim:

1. A hand-grip for a racket of the type having a hand-grip sleeve formed of longitudinally extending components joined together about a shaft of the frame of the racket which is connected to a hitting surface, wherein the hand-grip sleeve comprises at least two, at least similar, shell parts made of a hard, elastic material, said shell parts having longitudinally extending edge portions which are arranged in such a way that, when they are formed into said hand-grip sleeve and the hand-grip sleeve is applied firmly against the shaft, adjacent end faces of said edge portions don't abut against one another, and wherein the hand-grip sleeve is provided with an elastic covering which presses it onto the shaft on all sides.

2. A hand-grip according to claim 1, wherein the shell parts are formed of a hard material having a low friction coefficient.

3. A hand-grip according to claim 2, wherein the shell parts are formed of a spring-elastic plastic.

4. A hand-grip according to claim 3, wherein the shell parts have projections which engage against the shaft.

5. A grip according to claim 4, wherein said projections are longitudinally extending ribs which extend inwardly from an inside wall of the shell parts.

6. A hand-grip according to claim 5, wherein the ribs are elastically deflectable.

7. A grip according to claim 5, wherein the shell parts, in cross section, are U- or trough-shaped and the ribs are arranged on the inside of a bottom wall thereof.

8. A hand-grip according to claim 7, wherein the ribs are arranged to extend perpendicularly to said bottom wall of the U- or trough-shaped of the shell parts.

9. A hand-grip according to one of the claim 5, wherein parting planes between adjacent shell parts are provided at sides thereof which extend parallel to longitudinal sides of the shaft.

10. A hand-grip according to claim 9, wherein at least some of the ribs are mounted in such a way relative to the shaft, in an installed position, that they press laterally against sides of the shaft so as to be laterally, elastically deflectable relative thereto.

11. A hand-grip according to claim 5, wherein parting planes between adjacent shell parts are provided at sides thereof which extend diagonally relative to longitudinal sides of the shaft.

12. A hand-grip according to claim 11, wherein at least some of the ribs are mounted in such a way relative to the shaft, in an installed position, that they press laterally against sides of the shaft so as to be laterally, elastically deflectable relative thereto.

13. A hand-grip according to claim 5, wherein at least some of the ribs are mounted in such a way relative to the shaft, in an installed position, that they press laterally against sides of the shaft so as to be laterally, elastically deflectable relative thereto.

14. A hand-grip according to claim 4, wherein an adjusting mechanism is provided for longitudinally displacing the hand-grip sleeve along the shaft of the frame.

15. A hand-grip according to claim 4, wherein said projections are formed by a wavy shaping of the shell parts.

16. A hand-grip according to claim 1, wherein the shell parts are elastic, in a springy manner, in a direction toward and away from the shaft.

17. A hand-grip according to claim 16, wherein the shell parts are configured to behave in a springy-elastic manner.

18. A hand-grip according to claim 1, wherein the edge portions of the shell parts have profiles that engage with one another.

19. A hand-grip according to claim 18, wherein the edge portions of the shell parts have at least one of inter-engaging catch and/or wedging members.

20. A hand-grip according to claim 19, wherein said inter-engaging members comprise pins and bushings.

21. A hand-grip according to claim 1, wherein a soft-elastic plastic is sprayed around the hand-grip sleeve.

22. A hand-grip according to claim 1, wherein a grip shell grip strip is wound around the hand-grip sleeve.

* * * * *